United States Patent [19]

Souren

[11] Patent Number: 4,560,091

[45] Date of Patent: Dec. 24, 1985

[54] STATIONARY BEER CONTAINER

[75] Inventor: Hubertus J. Souren, Enschede, Netherlands

[73] Assignee: Grolsche Bierbrouwerij B.V., AB Enschede, Netherlands

[21] Appl. No.: 475,551

[22] Filed: Mar. 15, 1983

[30] Foreign Application Priority Data

Mar. 16, 1982 [NL] Netherlands ..... 8201086

[51] Int. Cl.[4] ..... B65D 83/14

[52] U.S. Cl. ..... 222/155; 222/148; 222/399; 222/400.7

[58] Field of Search ..... 222/154, 155, 394, 399, 222/400.7, 400.8, 464, 509, 511, 518, 544, 559, 566, 567, 148, 151; 73/323; 137/206, 207.5, 212

[56] References Cited

U.S. PATENT DOCUMENTS 3,311,267 3/1967 Lee et al. ..... 222/155
3,790,039 2/1974 Zucconi ..... 222/400.7 X
3,956,934 5/1976 White ..... 222/155 X
4,125,209 11/1978 Bailey ..... 222/400.7

FOREIGN PATENT DOCUMENTS 7806760 12/1979 Netherlands ..... 222/400.7

*Primary Examiner*—Joseph J. Rolla
*Assistant Examiner*—Michael S. Huppert
*Attorney, Agent, or Firm*—H. Mathews Garland

[57] ABSTRACT

A stationary beer container having upper and lower end connections coupled with a flow line coupling and valve assembly adapted to cooperate with a standard beer tap head used with barrels or kegs. The flow line coupling and housing assembly of the invention is connected with a line to the lower end of the beer container and a vertical line to the upper end of the container including a transparent section for determining the beer level in the container. The same type of tap head is used for tapping beer from the container, filing the container, and cleaning the container.

10 Claims, 6 Drawing Figures

STATIONARY BEER CONTAINER

BACKGROUND OF THE INVENTION

1. Field of the Invention

This invention relates to stationary beer containers and more specifically to stationary beer container having a fluid flow system using a standard beer tap head for filling the container with beer, dispensing beer from the container, and cleaning the container.

2. History of the Prior Art

Generally, stationary beer containers are located in the basement of a cafe, restaurant, or the like. Such beer containers are filled from tank cars. When a stationary beer container is emptied, a new full container is connected by disconnecting the empty container from the beer line between the container and the dispensing location and reconnecting the line to a full container. Additionally, a line between carbon dioxide cylinders used to supply flow pressure must be connected from the empty container and reconnected to the full container, as disclosed in Dutch patent application No. 6401781. From time to time the empty containers have to be cleaned with water and organic cleaning liquid, for which flow couplings are necessary to conduct the cleaning liquid and rinsing water to and from the container. Connecting and reconnecting flow couplings with such containers is time consuming and provides chances for mistakes in making the connections.

The use of a stationary beer container having a capacity, for example, of 1000 liters is preferable to the use of movable barrels having a capacity of only 50 liters. Where beer consumption is large and beer barrels are stored in a basement it is necessary for someone to go to the basement to connect a new barrel, during which time it is not possible to draw and dispense beer. The cleaning of empty barrels is done at a brewery and, thus, an innkeeper is not required to do the cleaning.

Connection with a new beer barrel for dispensing beer is much more simple than the switching between an empty stationary container and a full stationary container because of the fact that a tap rod is connected into the bung hole of the barrel. The tap rod comprises a vertical tube extending within the barrel to the bottom thereof. The upper end of the tap rod is closed by an end wall. Below the end wall openings providing an outlet into a space above the upper end of the tube around which a funnel shaped housing is provided. The space between the tube and the housing is closed by a rubber sleeve around the tube pressed outwardly by spring pressure so that the opening, and thus, the barrel interior is closed with respect to the space above the barrel as, for example, shown in Dutch patent application Nos. 6910931 and 7806761. To make a connection with a beer barrel, a beer line is provided with a tap head that has a connection to a carbon dioxide cylinder or other gas under pressure. The mounting of the tap head on the tap rod provides a connection between the carbon dioxide cylinder and the beer barrel and between the beer barrel and a beer dispensing tap, present at the location of use. By pressing downwardly on the tap head lever, the rubber sleeve is moved downwardly on the tube against the action of the spring, uncovering the openings in the line in the tube of the tap rod connecting the tube in the beer barrel to the tap, as illustrated in Dutch patent application No. 7806761. Innkeepers are accustomed to working with such tap heads so that no errors are made when the barrels are so connected.

SUMMARY OF THE INVENTION

An object of the present invention is to provide a stationary beer container with means that at least in part correspond with prior art tap rods so that an innkeeper may use a standard tap head with a stationary container. Additionally, it is an object of the invention that the means provided may be used for connecting a tank car containing beer with a stationary container and a cleaning device for cleaning the container may also be connected with the stationary container.

The objects of the invention may be achieved because of the fact that the stationary beer container is provided with a connecting means which may be coupled with a known tap head for drawing beer from barrels. The connecting means with the stationary beer container is also connected with a lower connection into the stationary beer container and through another connection with a substantially vertical line to the upper end of the stationary beer container. An innkeeper connects a conventional beer tap head with the connection to the stationary beer container using exactly the same manipulations as used to connect the tap head with beer barrels. As previously stated, the same tap head can be used for both cleaning and filling the stationary beer container.

Preferably, the stationary beer connection means of the invention comprises a housing member and a body assembly fitting therein and connecting therewith which substantially corresponds with a standard tap rod present in beer barrels. Thus, it is possible by simple means to make a prior art tap rod suitable for use with a stationary beer container.

Preferably, the substantially vertically extending line between the side connection of the housing part and the upper connection of the stationary beer container comprises transparent material along a part of its length, so that the beer level in the stationary beer container can be determined. During the cleaning of the stationary beer container, the cleaning and/or rinsing fluid flows under pressure through the vertical line so that such line is cleaned.

BRIEF DESCRIPTION OF THE DRAWINGS

The present invention will be better understood with the aid of the drawings in which:

FIG. 6 is a side view in section showing another embodiment of the flow line coupling and valve assembly of the invention.

DETAILED DESCRIPTION OF THE PREFERRED EMBODIMENT

Figure 1:
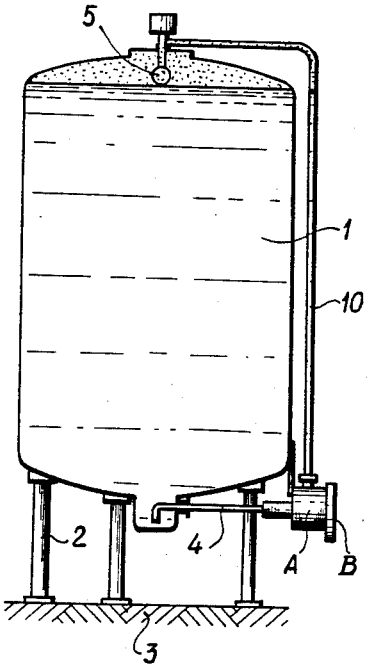
FIG. 1 is a schematic side view partially in elevation and section showing a full stationary beer container in accordance with the invention.

Referring to the drawings, a stationary beer container 1 having the shape of a vertical cylinder is supported on legs 2 resting on a floor 3 which may be in a storage room in the celler in a cafe or restaurant. The container 1 may, for example, have a capacity of at least 1000 liters. A flow line 4 connects into the lower end of the container. A nozzle 5 is mounted in the upper end of the container for suppling gas under pressure, preferably carbon dioxide gas, and is also used for cleaning the container 1 as discussed hereinafter. A flow line coupling A and valve assembly designated B are connected with the line 4 and with a vertical line 10 extending to the nozzle 5 at the top of the container. Preferred embodiments of the flow line coupling and valve assembly designated A and B are shown in FIG. 5 and 6.

Figure 5:
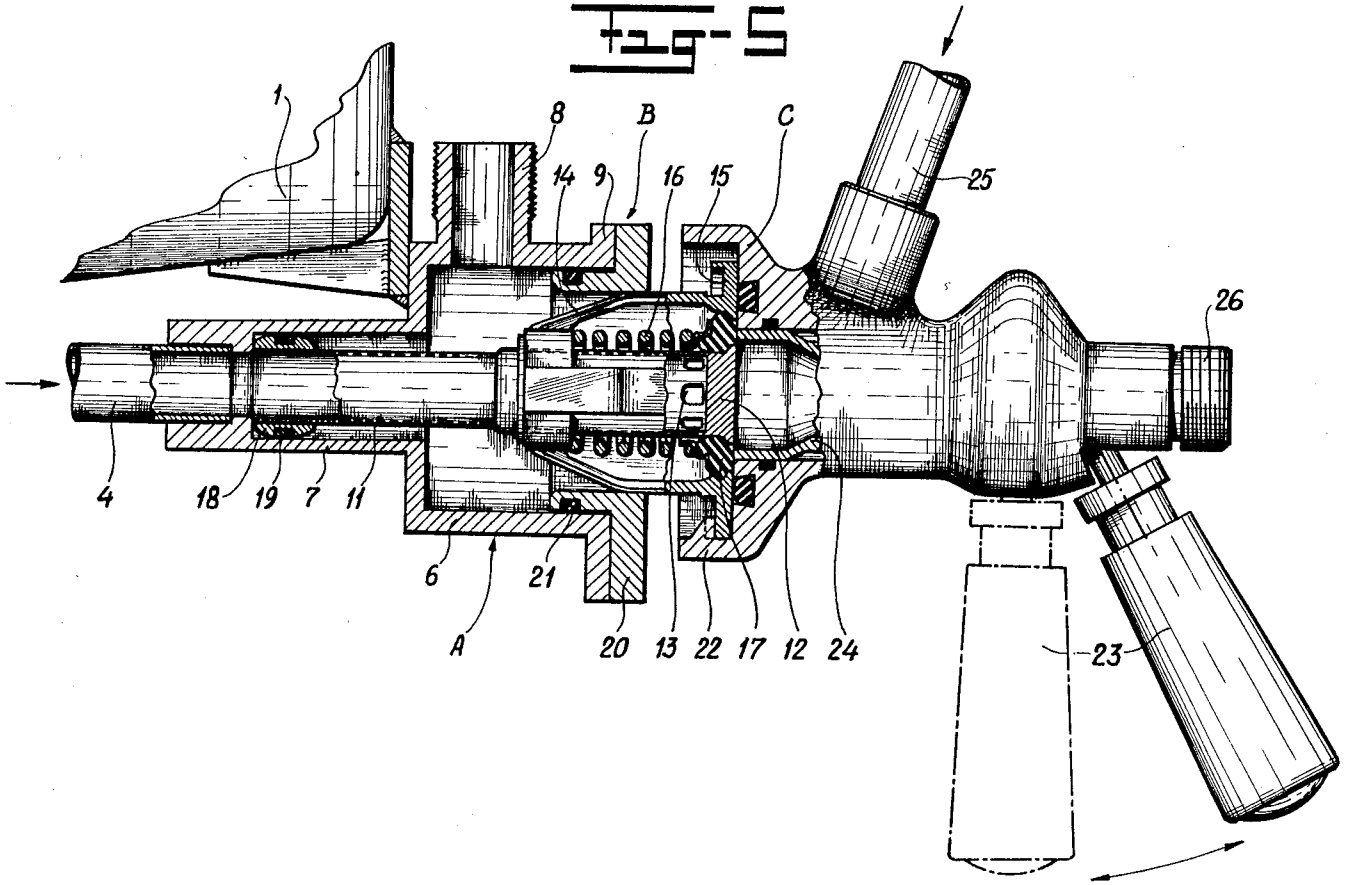
FIG. 5 is a fragmentary side view in section and elevation of the flow line coupling and value assembly of the invention connected with a prior art tap head.
Figure 5:
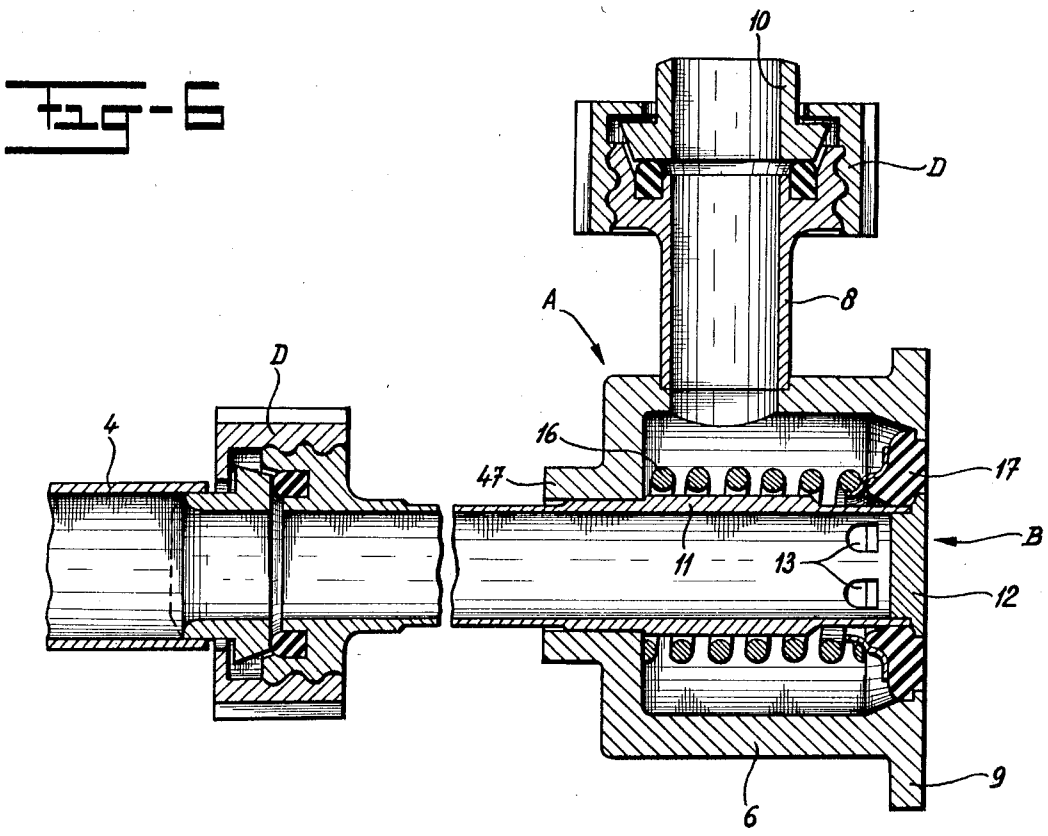

Referring to FIG. 5, the coupling A of the flow line coupling and valve assembly comprises a cup-shaped housing 6 having a central tubular first end connection 7, a side connection 8 opening into the portion 6, and an opposite second end flange 9. The housing 6 is secured by a bracket welded to the container 1 and is connected with the line 4 by the connection 7 as also illustrated in FIG. 1. The side connection 8 is connected with the partially transparent line 10, as shown in FIG. 1, leading to the nozzle 5.

As also shown in FIG. 5, the valve assembly B is connected with the housing 6 providing apparatus which corresponds with tap rods used for beer barrels. A tap head C is coupled by a bayonet connection with the outer end of the assembly B. The assembly B includes a central tube 11 closed at the outer thereof by a cross wall 12. The tube 11 is provided with windows 13 inward from the wall 12. An enlarged housing 14 is mounted at an inward end around the tube 11 and is provided with windows opening through the housing into the space between the housing and the tube 11. The outward end of the housing 14 has an annular flange 15 disposed in spaced relation around the wall 12 for connecting the tap head C with the assembly B. The inward end of the housing 14 provides an annular seat for a pressure spring 16 which presses a rubber annular sealing sleeve 17 outwardly between the outer edge of the cross wall 12 of the tube 11 and the inner edge of the housing 14 at the flange 15. The sleeve 17 functions as a valve moving from a first closed position shown in FIG. 5 inwardly along the tube 11 from the windows 13 to a second operating position on the opposite side of the windows. The inward end of the tube 11 is provided with a fixed collar 18 having an o-ring seal 19 providing a seal around the inward end tube 11 with inner wall of the reduced connector portion 7 of the housing 6. The assembly B includes a flange connector collar 20 secured by soldering or the like with the housing 14 and connected with the flange 9 of the housing 6 by bolts, not shown. An o-ring seal 21 seals between the flange collar 20 and the inside wall of the housing 6.

The tap head C includes anectable by sing part 22 connectable by rotation to flange 15 on the housing 14 on the assembly B. The tap head C has a tubular member 24 forming a valve operator and flow line which is movable inwardly by a lever 23 on the tap head. A side connection 25 for gas under pressure is provided on the part 22. A flow connection 26 is provided on the tap head for connecting with a beer dispensing tap, not shown.

As shown in FIG. 1, the tap head C is not mounted on the assembly B. As evident from FIG. 5, when the tap head is not mounted, the spring 16 keeps the rubber sleeve 17 in the position shown in FIG. 5 closing the space between the flange 15 and the end wall 12 so that the contents of the stationary container 1 may not flow outwardly through the flow line coupling A and the assembly B. Beer from the container enters the tube 11 through the flow line 4, flows outwardly from the tube 11 through the windows 13 into housing 14 and from the housing 14 in the windows therein into the housing 6 of the coupling A. The beer rises through the connection 8 into the partly transparent tube 10. The tube 10, of course, is connected through the nozzle 5 into the container 1. Thus, the beer in the tube 10 will be at the same height as in the container 1. A quantity of carbon dioxide gas under pressure is shown in the stationary container 1 above the liquid beer. When the tap head C is connected with the assembly B as shown in FIG. 5 and the lever 23 is not operated in a clockwise direction, the rubber valve sleeve 17 remains closed and the beer level is seen in the transparent portion of the line tube 10. Pivoting the lever 23 in a clockwise direction as shown in FIG. 5 to the position shown in phantom lines moves the tube 24 inwardly pressing the rubber sleeve 17 from the first closed position shown to a second operating position, not illustrated, on the other side of or inward of the windows 13 in the tube 11.

Figure 2:
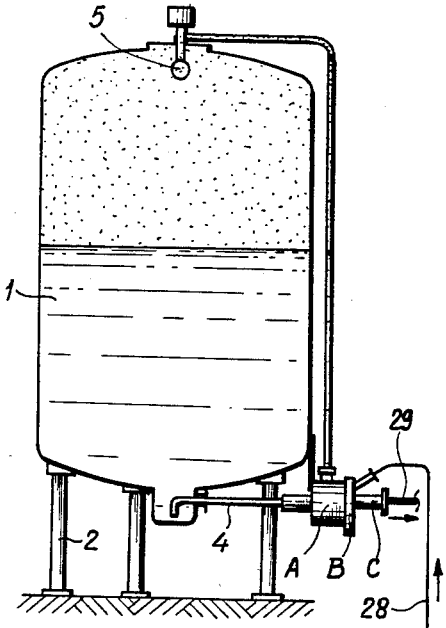
FIG. 2 is a side view similar to FIG. 1 showing the stationary beer container connected with a carbon dioxide gas system and a portion of the beer withdrawn from the container.

The lever 23 is operated for drawing beer with the stationary container connected as shown in FIG. 2 to a source of carbon dioxide gas in the cylinders 27 which are connected through a line 28 to the connection 25 of the tap head C. A line 29 as illustrated in FIG. 2 is connected to the tap head connection 26 and leads to a beer dispensing tap, not shown. The line 29 may be cooled and may include a pump, not shown, depending upon the distance between the location of dispensing the beer and the stationary container. Carbon dioxide gas from the cylinders 27 passes through the line 28 into the connection 25, inwardly around the tube 24 and the open sleeve 17 through the housing 14, outwardly through the windows in the housing 14 into the housing portion 6 of the coupling A and upwardly through the connection 8 and the line 10 into the top of the stationary container through the nozzle 5. Thus, when a full stationary container 1 is to be put into service, the tap head C is connected to the assembly B. The carbon dioxide line 28 and the beer line 29 will have been previously connected with the tap head C. With the lever 23 moved clockwise to the open position the carbon dioxide gas will then follow the previously described route from the cylinders 27 into the upper end of the stationary container 1. The beer in the stationary container is pressed downwardly and flows through the line 4, the tube 11, the windows 13 in the tube 11, radially outwardly into the tube 24 and in the tube 24 through the connection 26 into the beer line 29 to the tap, not shown.

With the stationary container connected as illustrated in FIGS. 2 and 5, the lever 23 is pivoted counter-clockwise, to the right in FIG. 5, and the force of the spring 16 moves the sleeve 17 back to the right to the first operating closed position at which the beer communicates through the windows 13 and the housing 14 into the line 10 to show the level of the beer in the stationary container.

Figure 3:
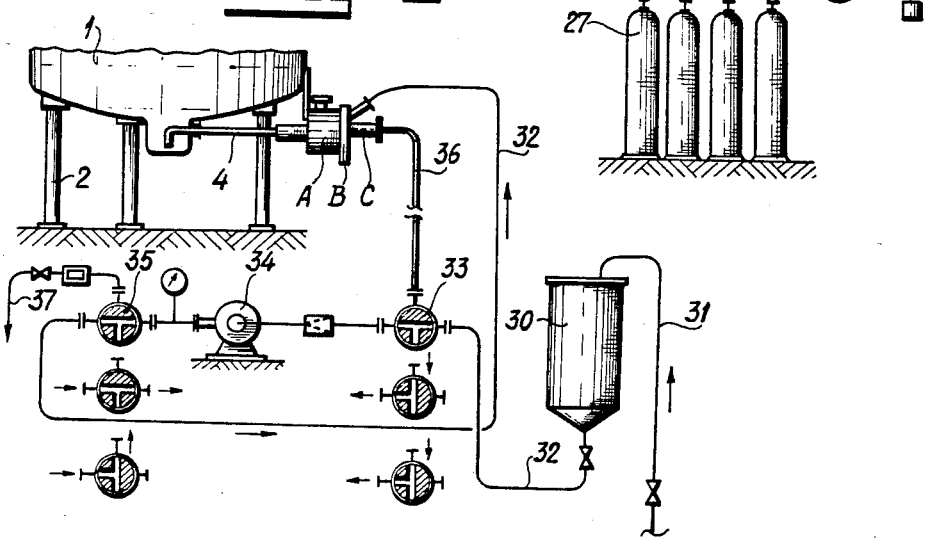
FIG. 3 is a fragmentary side view of the stationary beer container shown in FIGS. 1 and 2 connected with a cleaning system.

FIG. 3 represents an empty stationary container 1 during the cleaning of the container with water and/or a chemical cleaning agent. The cleaning agent is in a container 30 connected to a water line 31. A line 32 from the container 30 includes a first three-way valve 33, a pump 34, and a second three-way valve 35 from which the line 32 extends to the connection 25 of the tap head C. The connection 26 of the tap head C is connected with a line 36 extending to three-way valve 33. From the second three-way valve 35 a line 37 extends to a drain, not shown. To supply water and a cleaning agent to the container 1, the three-way valve 33 and 35 are in the positions shown in the upper views of the valves in FIG. 3. The cleaning liquid enters the container 1 through the connection 25 when the lever 23 is pivoted clockwise as represented in the phantom lines of FIG. 5. The cleaning liquid enters the container 1 through line 10 and the nozzle 5 thereby cleaning the line 10. Without this apparatus for cleaning the line 10, liquid level gauges are not suitable for beer containers because of pollution in the gauge line. As shown in FIG. 3 during the filling of the container 1 the valve 33 is closed in the line 36 and thus, the cleaning liquid cannot flow from the container 1 in the line 36. When the container is sufficiently filled with cleaning liquid, the three-way valve 33 is rotated to the middle position shown in FIG. 3 so that the pump 34 pumps the cleaning liquid or rinsing water through the stationary container 1.

After the cleaning and/or rinsing is completed, the three-way valve 33 and 35 are rotated to positions at which the liquid in the container flows from the container 1 through the line 36, the three-way valve 33, the pump 34, the three-way valve 35, and the discharge line 37 to the sewer, not shown. The cleaning of the container is thus performed by an innkeeper using the conventional tap head C with which he is familiar.

Figure 4:
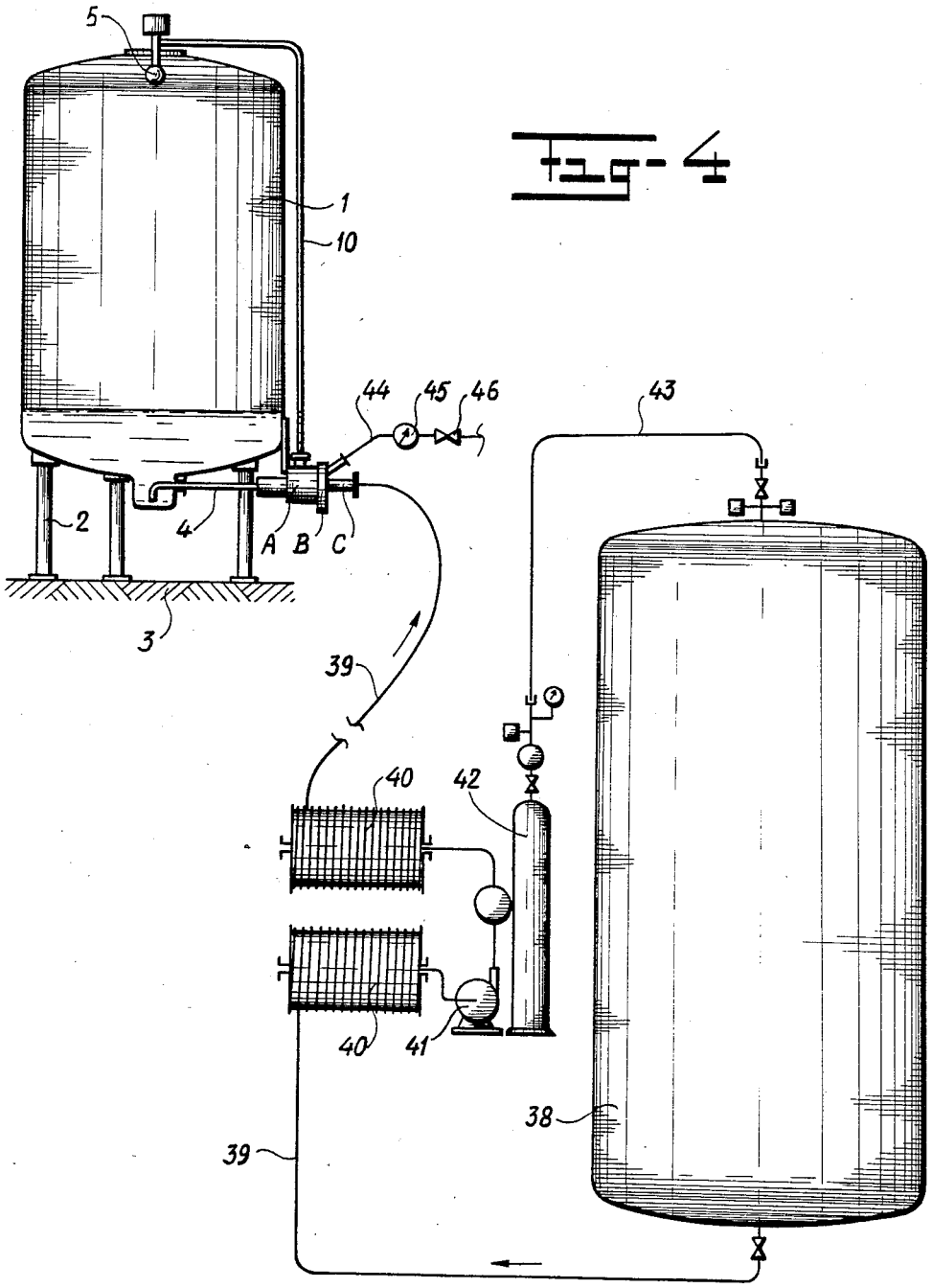
FIG. 4 is a schematic side view in elevation of the stationary beer container connected with a tank car for filling the container.

FIG. 4 illustrates the connection of the stationary beer container 1 fitted with the tap head C with a tank car 38 for refilling the container 1 with beer. The tap head C is connected through a flexible hose 39 which operates over two wheels 40 and is connected through a pump 41. A carbon dioxide cylinder 42 is connected through a line 43 to the upper end of the tank car 38 to apply an over pressure to the beer in the tank car 38 for flowing the beer to the container 1. The flexible hose 39 connects with the tap head C at the connection 26. A line 44 is connected from the connection 25 of the tap head C to a manometer 45 and through a valve 46 to the atmosphere for venting the carbon dioxide gas in the tank car 38 during the filling of the container 1. The container 1 is filled from the lower end of the container through the tube the 11 and the line 4. As the container fills the carbon dioxide gas flows to the atmosphere.

After filling the stationary container 1, the lever 23 of the tap head C is pivoted back counter-clockwise, to the right, as shown in FIG. 5, returning the sealing ring 17 to the position of FIG. 5 closing flow to the container 1 through tap head. The tap head C may be then removed providing a full closed stationary container 1 as shown in FIG. 1.

The drawing of beer, the cleaning of the stationary container 1, and the filling of the container is all done with the same type of tap head C. For drawing beer the tap head C is connected to the beer line 29 and the carbon dioxide line 28. For cleaning a tap head C is connected with the lines 32 and 36 as illustrated in FIG. 3. For filling the container 1 a tap head C forms a part of the tank car 38 and is connected with lines 39 and 44 as shown in FIG. 4.

It will be recognized that while carbon dioxide gas has been disclosed, other gases under pressure may be used during drawing beer and filling the container 1.

A second embodiment of the flow line coupling A and the assembly B are illustrated in FIG. 6. The coupling A comprises the chamber portion 6 with the flange 9 and the side connection 8 which includes a coupling D for connection with the vertical line 10. The assembly B also includes the tube 11, the end closure wall 12 in the tube 11, the windows 13 in the tube 11, the annular valve seal ring 17, and the pressure spring 16 for operating the seal 17. The inward end of the spring 16 abuts the inward end of the chamber and the coupling portion 6. The tube 11 extends in sealing relationship through a flange connection portion 47 of the coupling portion 6. The tube 11 is secured by welding or soldering with the connection 47. The other end of the tube 11 connects by a coupling D to the flow line 4 to the stationary container 1. The couplings D make it possible to disconnect the flow line coupling A and assembly B in case the valve sleeve 17 requires replacement. The embodiment shown in FIG. 6 functions in exactly the same way as the apparatus shown in FIG. 5. The tap head C is connected with the assembly B at the flange 9.

In accordance with the invention the stationary beer container 1 including the flow line coupling A and the assembly B makes it possible to switch from keg beer to container beer with the advantages of drawing from kegs being retained and the disadvantages avoided.

I claim:

1. Apparatus for storing and dispensing beer comprising:

a stationary beer container;

a lower flow connection into said container;

an upper flow connection into said container;

a substantially vertical flow line connected at a first upper end into said upper flow connection for separate pump functions of gas flow during beer dispensing, cleaning fluid flow, and measurement of beer level in said container;

a flow line coupling and valve assembly connected between said lower connection and a second lower end of said vertical flow line including means comprising an annular coupling flange for connecting a tap head to said flow line coupling for flow communication with said flow line coupling and operation of said valve assembly for controlling flow between said tap head and said flow line coupling;

said flow line coupling having a central tube closed at an outer end and having port means inward from said outer end and defining flow passage means into said lower flow connection and a housing around and spaced from said central tube defining second annular flow passage means around said first central tube and opening into said lower end of said vertical flow line;

said valve assembly including an annular valve member movable along said tube between first and second operating positions on opposite sides of said port means;

said valve member shutting off flow through said tap head connection means while permitting flow through said port means between said first and said second flow passages at said first operating position; and said valve member at said second operating position isolating said first flow passage means from said second flow passage means inward from said valve member while directing flow between said first and said second flow passage means outward of said valve member and separate flow channels in a tap head when said tap head is connected with said tap head connecting means.

2. Apparatus in accordance with claim 1 wherein said flow coupling comprises said housing defining a chamber having a first end opening connected into said lower flow connection into said container, an opposite second end opening away from said container, and an upper side opening connected with said lower end of said vertical flow line;

said central tube in said chamber being spaced from the inner walls thereof opening at one end into said lower flow connection and closed at the opposite end thereof, said tube having a bore defining said first flow passage means into said lower flow connection and said chamber around said tube defining said second flow passage means opening into said lower end of said vertical flow line, said port means in said tube communicating said tube bore with said chamber;

said second opposite end opening of said housing being spaced from and defining an annular opening around said closed end of said tube;

said housing having a flange around said opposite end opening for connection of said tap head; and said valve member fitting in sealing relation around said tube and in said housing opening and being movable along said tube between said first operating position sealing said housing opening while uncovering said port means to communicate said first flow passage means with said second flow passage means and said second operating position inwardly on said tube from said port means to isolate said first and second flow passage means for communicating said first flow passage means with one flow channel in a tap head connected with said flange and for communicating said second flow passage means with a second separate flow channel in said tap head when said valve member is engaged by an operating tube of said tap head and moved by said tube to said second operating position.

3. Apparatus in accordance with claim 2 wherein, said valve member is an annular seal adapted to fit and seal said annular end opening against flow at said first operating position, and a spring is mounted around said tube in said chamber engaging said valve member and urging said valve member along said tube into said sealing relationship in said annular opening, said spring being compressible for movement of said annular seal to said second operating position on said tube.

4. Apparatus in accordance with claim 3 including a releasable coupling connecting said flow line coupling to said lower end of said flow line and another releasable coupling connecting said flow line coupling with said lower connection into said container.

5. Apparatus in accordance with claim 4 wherein at least a portion of said vertical flow line is transparent for observing the liquid level in said container.

6. Apparatus in accordance with claim 3 wherein said annular seal has an outer face sealingly engageable by an operator tube and flow member in said tap head, said operator tube moving said annular seal from said first operating position to said second operating position and said operator tube of said tap head directing flow between a dispensing nozzle of said tap head and said first flow passage of said flow line coupling and directing separate flow between said second flow passage of said coupling and a gas connection on said tap head when said annular seal is at said second operating position.

7. Apparatus in accordance with claim 6 wherein at least a portion of said vertical flow line is transparent for observing the liquid level in said container.

8. Apparatus in accordance with claim 6 including a releasable coupling connecting said flow line coupling to said lower end of said vertical flow line and another releasable coupling connecting said flow coupling with said lower connection into said container.

9. Apparatus in accordance with claim 8 wherein at least a portion of said vertical flow line is transparent for observing the liquid level in said container.

10. Apparatus in accordance with claim 6 including a tap head connected with said flow coupling and a supply line connected with said gas connection on said tap head for cleaning and rinsing liquid, valve means in said supply line for controlling flow through said supply line, a discharge line connected with said dispensing nozzle, and valve means in said discharge line for controlling discharge of cleaning and rinsing liquid from said container.

* * * * *